US009386901B1

(12) United States Patent
Baker

(10) Patent No.: US 9,386,901 B1
(45) Date of Patent: Jul. 12, 2016

(54) DUST PAN WITH CLOSURE

(71) Applicant: Donald Baker, Huntington Beach, CA (US)

(72) Inventor: Donald Baker, Huntington Beach, CA (US)

( * ) Notice: Subject to any disclaimer, the term of this patent is extended or adjusted under 35 U.S.C. 154(b) by 0 days.

(21) Appl. No.: 14/545,932

(22) Filed: Jul. 9, 2015

(51) Int. Cl.
*A47L 13/52* (2006.01)

(52) U.S. Cl.
CPC ..... *A47L 13/52* (2013.01)

(58) Field of Classification Search
CPC ..... A47L 13/52; A01K 29/00; E01H 1/1206; E01H 1/12
See application file for complete search history.

(56) References Cited

U.S. PATENT DOCUMENTS

| | | | | |
|---|---|---|---|---|
| 500,826 | A | 10/1893 | Miller | |
| 760,467 | A | 5/1904 | Michaud | |
| 4,361,245 | A | 11/1982 | Allen | |
| 4,572,560 | A | 2/1986 | Grandlouis | |
| 5,513,883 | A | 5/1996 | Segla | |
| 5,894,096 | A | 4/1999 | Kotraba | |
| 6,641,188 | B2 * | 11/2003 | Arceo | E01H 1/1206 15/257.3 |
| 6,643,892 | B1 | 11/2003 | Murphy | |
| 6,732,402 | B1 | 5/2004 | Hsu | |
| 6,736,436 | B1 * | 5/2004 | Tsou | E01H 1/1206 15/257.6 |
| 7,404,229 | B2 * | 7/2008 | Monahan | A47L 13/52 15/257.1 |
| 8,919,708 | B1 | 12/2014 | Graves | |
| 2002/0038957 | A1 | 4/2002 | Harrison | |

OTHER PUBLICATIONS

U.S. Appl. No. 15/544,602, filed Jan. 23, 2015, Baker.

* cited by examiner

*Primary Examiner* — Shay Karls
(74) *Attorney, Agent, or Firm* — Haynes and Boone, LLP

(57) ABSTRACT

A hollow dust pan has a bottom wall, two opposed upstanding side walls, an upstanding rear wall, a top wall, an open front, and a movable lid cover over said open front. A handle is attached to the top wall adjacent the open front to extend rearwardly adjacent to and spaced apart from the top wall. A lid cover has a hinge member rotatably attached to the handle to position a peripheral edge of the lid cover at a front peripheral edge of the open front. A lever with a pivot pin is rotatably attached to the handle and the lever has a lever arm member rotatably engaged at a lower end with the hinge member. A strip spring is attached at a lever handle member of the lever to urge the hinge member to position the lid cover in a closed position.

11 Claims, 5 Drawing Sheets

DUST PAN WITH CLOSURE

BACKGROUND OF THE INVENTION

This invention relates to devices for cleaning and more particularly to dust pans. The new dust pan is a hollow container with a handle and a lid.

Dust pans for use with brooms and other cleaning tools for collection of dust, dirt, debris and the like that have a generally flat bottom wall, two opposed upstanding side walls and an upstanding back wall are generally known in the art. A handle may be fastened to the back wall to extend rearwardly or an elongated handle may be attached to extend upwardly for ease of use of the dust pan while standing. A partial top wall may also be attached to the top edge of the two side walls and a handle may be attached between the front edge and rear of the dust pan. A handle may also be rotatably attached to the dust pan structure.

Dust pans that have attached garbage bags to collect dust, dirt and debris are also known. The dust pan structure may be generally tubular in structure with a flat bottom wall, two opposed side walls, a front pan member, and with front and back openings. There may be attachable interchangeable filters that are attachable to the front or rear openings using spring loaded clips and locks. However, there may not be an easily manipulated lid for covering the dust pan open ends since such structures support use of attached bags.

There is a need for a generally light weight, hand holdable dust pan that can be easily opened with the hand while the dust pan is held to allow collection of dust, dirt and debris, for the dust pan lid or closure to be retained in an open position, and then to close the dust pan to serve as a closed hollow container to transport the collected dust and dirt to a trash container while avoiding any spillage.

SUMMARY OF THE INVENTION

The present invention is directed to a dust pan for collection of dust, dirt, debris and the like. A hollow pan is formed by a bottom wall, two opposed upstanding side walls, an upstanding rear wall, a top wall, an open front, and a movable lid cover over said open front. A handle is attached to the top wall adjacent the open front to extend rearwardly adjacent to and spaced apart from the top wall. A hinge member is attached at an upper edge of the lid cover with a hinge pivot pin at an upper end inserted in a lower pin aperture of the handle to position a peripheral edge of the lid cover at a front peripheral edge of the open front. A lever with a pivot pin is rotatably attached to an upper pin aperture of the handle and the lever has a lever arm member rotatably engaged at a lower end with the hinge member. A strip spring is attached at a lever handle member of the lever to urge the hinge member to position the lid cover in a closed position.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
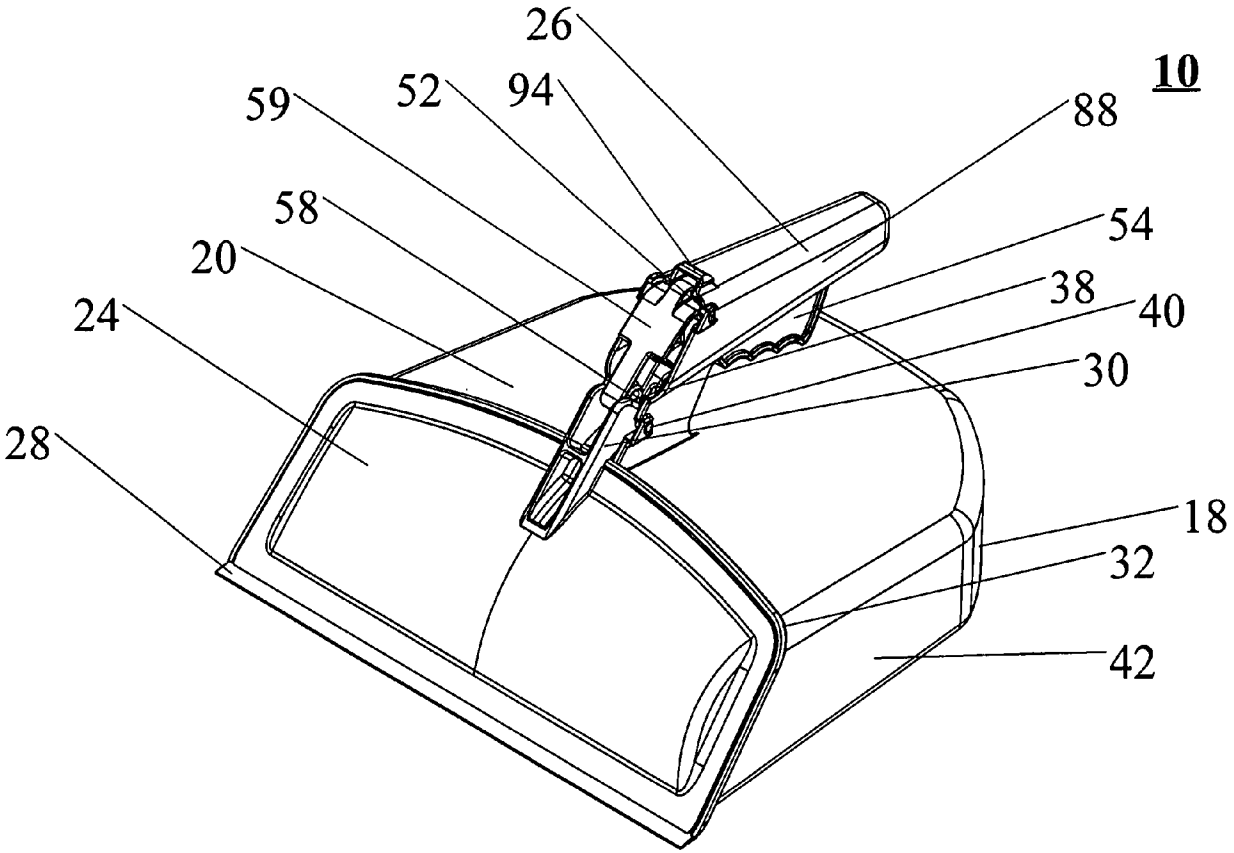
FIG. 1 illustrates a front-top perspective view of a dust pan according to an embodiment of the invention.
Figure 2:
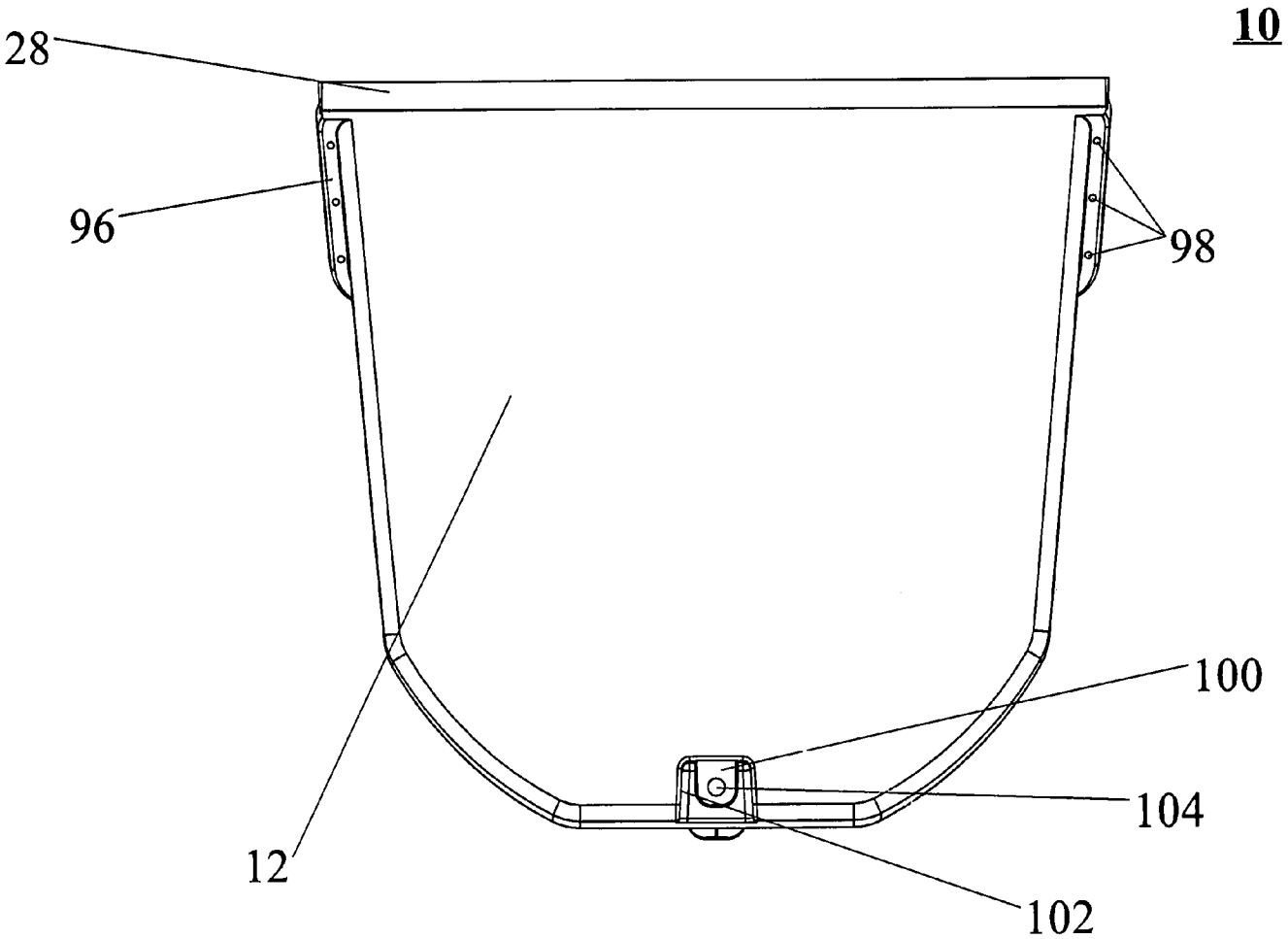
FIG. 2 illustrates a rear bottom perspective view of a dust pan according to an embodiment of the invention.
Figure 3:
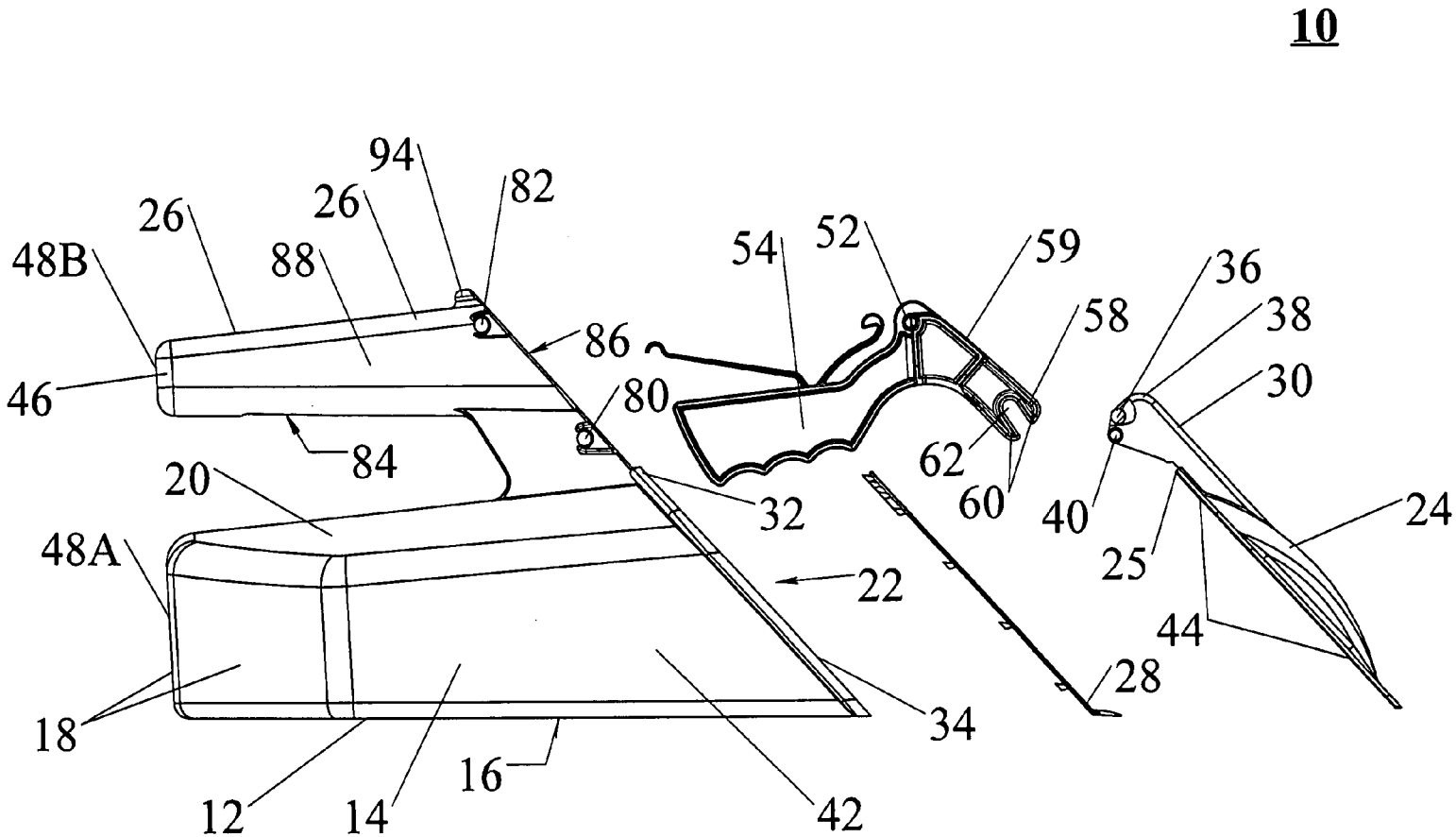
FIG. 3 illustrates an exploded right side elevation view of a dust pan according to an embodiment of the invention.
Figure 4:
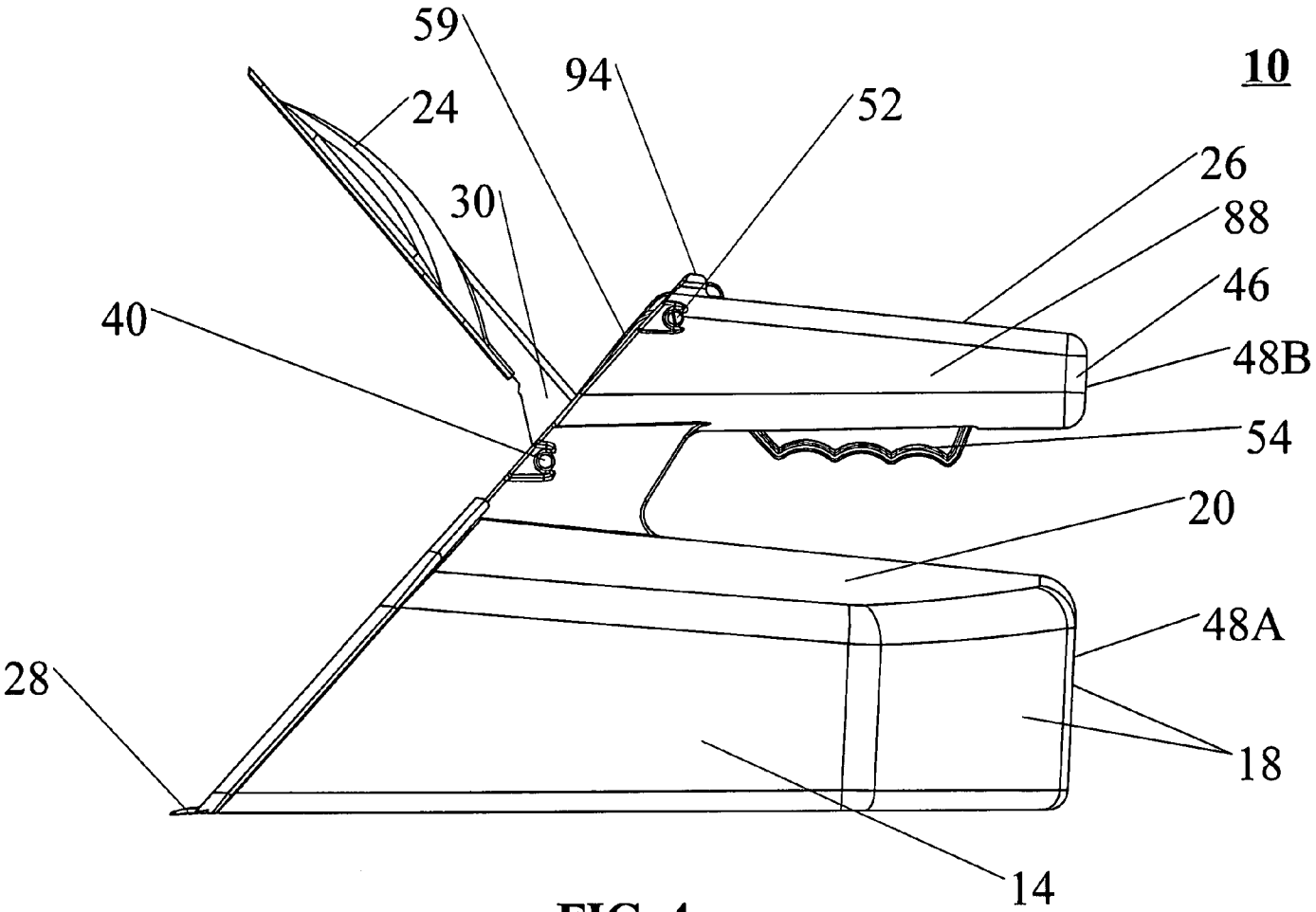
FIG. 4 illustrates a left side elevation view of a dust pan with the lid in an open position according to an embodiment of the invention.
Figure 5:
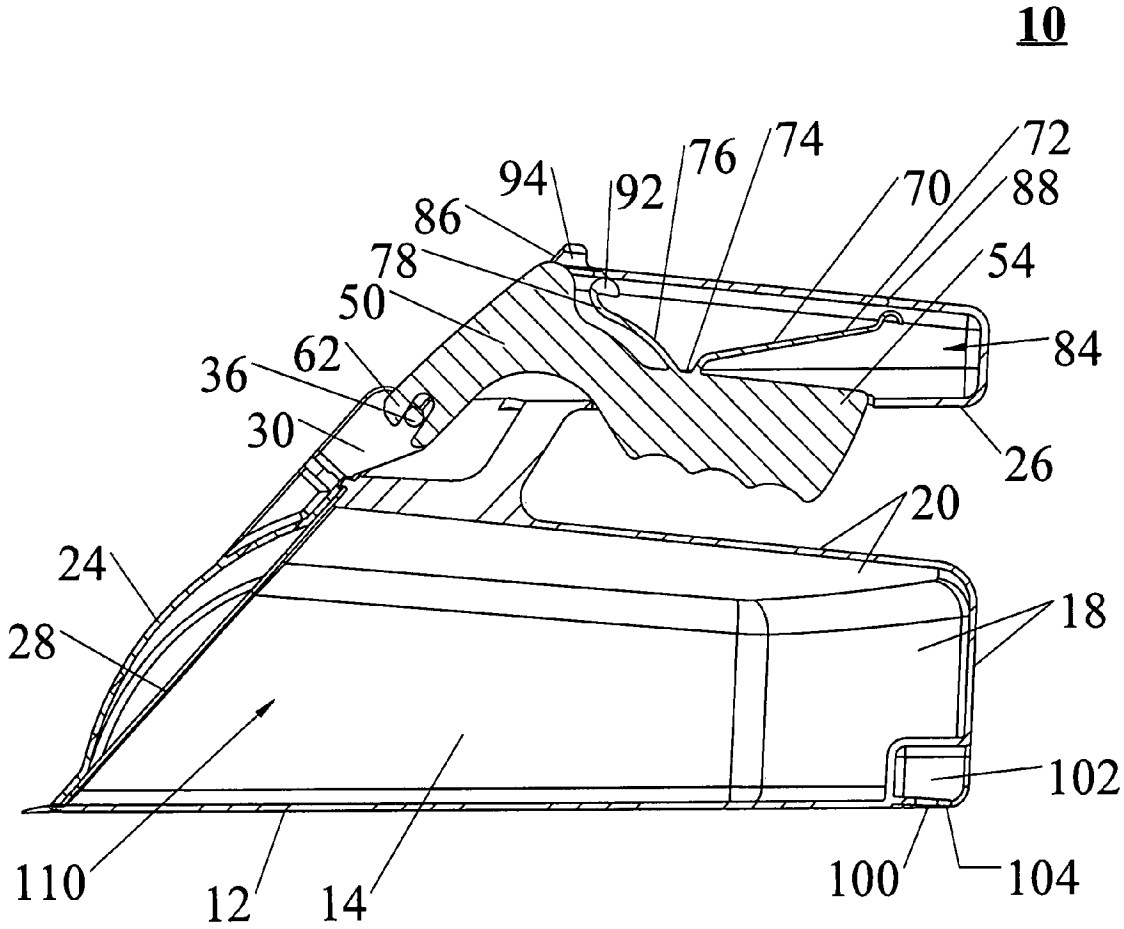
FIG. 5 illustrates a left side cross-sectional elevation view of a dust pan with the lid closed according to an embodiment of the invention.

Referring to FIGS. 1 through 5, a dust pan 10 has a bottom wall 12, two opposed upstanding side walls 14, 16, an upstanding back or rear wall 18, and a top wall 20 with an opening 22 and a lid 24 to form a hollow interior 110. A handle 26 is attached to the top wall 20 adjacent to the opening 22 with handle 26 grip position 88 extending rearwardly adjacent to and spaced apart from the top wall 20.

The lid 24 has a hinge member 30 extending upwardly above an upper edge 25 of the lid 24 and the hinge member 30 is rotatably attached at an upper end 38 to the handle 26 at a lower pin aperture 80. A lever 50 is rotatably attached to the handle 26 at an upper pin aperture 82 with a pivot pin 52 to serve as a fulcrum of the lever 50. A lever handle member 54 extending rearwardly of the pivot pin 52 is positioned in a recess 84 of the handle 26 and a lever arm member 56 extending outwardly through a forward opening 86 in the handle 26 extends generally downwardly for rotatable engagement with the hinge member 30. The lever arm member 56 may have a lower end 58 with two prongs 60 to form a fork end 62 to receive a fork pin 36 at an upper end 38 of the hinge member 30. The fork pin 36 is spaced apart from a hinge pivot pin 40 at the upper end 38.

The lever handle member 54 may be positioned in the recess 84 of the handle 26 to allow a user to grip the handle 26 with one hand and to operate the lever handle member 54 to cause the lever 50 to rotate and urge the lever arm member 56 rearwardly relative to the opening 22. This in turn will pull the fork pin 36 rearwardly causing the upper end 38 of the hinge member 30 to rotate about the hinge pivot pin 40 that is positioned in the lower pin aperture 80. By positioning the hinge pivot pin 40 rearwardly and below the position of the fork pin 36, as best viewed in FIG. 3, the rearward rotational movement of the fork pin 36 by the lever 50 causes the hinge member 30 to rotate outwardly away from opening 22 to move the lid 24 from a closed position to an open position.

The lever handle member 54 has a strip or bar spring 70 with a first spring member 72 attached on the top surface 74 of the handle member 54 with the first spring member 72 biased upwardly and rearwardly in the recess 84 to slidably abut the interior surface 90 of the grip portion 88 of the handle 26. The first spring member 72 urges the lever handle member 54 downwardly toward the top wall 20. A second spring member 76 is attached on the top surface 74 of the handle member 54 with the second spring member 76 biased upwardly and forwardly in the recess 84 to slidably abut the interior surface 90 of the grip portion 88 of the handle 26. The second spring member 76 has a catch tip 92 at its upper end 78 shaped to be received in a tip recess 94 formed in the handle 26 adjacent to the forward opening 86. When the lever 50 is rotated about the pivot pin 52 to move the lever handle member 54 upwardly in the recess 84 the second spring member 76 is urged forwardly to engage the tip recess 94 to latch the lever 50 and thereby to releasably retain the lid in an open position.

The dust pan 10 has been illustrated as having generally curved side walls 14 16 and back wall 18, with flat bottom wall 12 and curved top wall 20. The dust pan 10 may be formed in a plastic molding process that produces the parts illustrated in FIG. 3 as an exploded or disassembly view of the dust pan 10. The dust pan 10 may have a flexible seal 28 material attached on the peripheral edge 34 of the front opening 22 of the dust pan 10 body 42 for sealing closure of the lid 24 peripheral edge 44. There may also be a flange 96 with holes 98 therein at the bottom wall 12 at each side front edge for attachment of the flexible seal 28, as best viewed in FIG. 2. The dust pan 10 may also be formed using generally planar or flat members for the walls 12, 14, 16, 18 and 20 that are assembled and sealed at mating edges as understood in the art.

The rear wall 18 of the body 42 of the dust pan 10 and the end wall 46 of the handle 26 may have a flat wall portion 48A, 48B with the flat wall portions 48A and 48B formed to be generally in the same plane to allow positioning the dust pan 10 on a flat structural surface in an upright orientation with the lid 24 and opening 22 elevated. The rear wall 18 of the body 42 may have a hanging tab 100 recess 102 formed therein, as best viewed in FIG. 5, for attachment of a hanging tab 100 with a hole 104 formed therein for use to hang the dust pan 10 on a vertical wall hook, nail or the like.

While the invention has been particularly shown and described with respect to the illustrated embodiments thereof, it will be understood by those skilled in the art that the foregoing and other changes in form and details may be made therein without departing from the spirit and scope of the invention.

I claim:

1. A dust pan comprising:

a hollow pan formed by a bottom wall, two opposed upstanding side walls, an upstanding rear wall, a top wall, an open front, and a movable lid cover over said open front;

a handle attached to said top wall adjacent said open front with a grip extending portion rearwardly adjacent to and spaced apart from said top wall;

a hinge member attached at an upper edge of said lid cover with a hinge pivot pin at an upper end inserted in a lower pin aperture of said handle and configured to position a peripheral edge of said lid at a front peripheral edge of said open front;

a lever with a pivot pin rotatably attached to an upper pin aperture of said handle wherein said lever has a lever arm member rotatably engaged at a lower end with said hinge member; and a strip spring attached at a lever handle member of said lever and configured to urge said hinge member to position said lid cover in a closed position, wherein said strip spring comprises a first strip spring member attached at a top surface of said lever handle member that is disposed in a recess formed in a grip portion of said handle, and wherein said first strip spring member extends upwardly and rearwardly in said recess to slidably abut an interior surface of said grip portion and is configured to urge said lever handle member downwardly toward said top wall.

2. The dust pan as in claim 1, wherein a second strip spring member is attached at said top surface of said lever handle member that is disposed in said recess forming in said grip portion of said handle wherein said second strip spring member extends upwardly and forwardly in said recess to slidably abut said interior surface of said grip portion; and a catch tip is formed at an upper end of said second strip spring member positioned to engage a tip recess formed in said grip portion disposed adjacent a forward opening.

3. The dust pan as in claim 1, wherein a flexible seal is disposed at said front peripheral edge of said open front.

4. The dust pan as in claim 1, wherein said lever at said lower end has two prongs disposed to form a fork end to engage a fork pin that is positioned in said upper end of said hinge member wherein said fork pin is spaced apart from said hinge pivot pin and configured to rotate said hinge member upwardly when said lever handle member is forced upwardly away from said top cover.

5. The dust pan as in claim 1, wherein said rear wall has a first flat wall portion and an end wall of said handle has a second flat wall portion wherein said first flat wall portion and said second flat wall portion are disposed in a common plane.

6. The dust pan as in claim 1, wherein a hanging tab recess is formed in said rear wall disposed for attachment of a hanging tab having an aperture therein.

7. The dust pan as in claim 1, wherein said rear wall has a first flat wall portion and an end wall of said handle has a second flat wall portion wherein said first flat wall portion and said second flat wall portion are disposed in a common plane.

8. The dust pan as in claim 1, wherein a hanging tab recess is formed in said rear wall disposed for attachment of a hanging tab having an aperture therein.

9. A dust pan comprising:

a hollow pan formed by a bottom wall, two opposed upstanding side walls, an upstanding rear wall, a top wall, an open front, and a movable lid cover over said open front;

a handle attached to said top wall adjacent said open front with a grip extending portion rearwardly adjacent to and spaced apart from said top wall;

a hinge member attached at an upper edge of said lid cover with a hinge pivot pin at an upper end inserted in a lower pin aperture of said handle and configured to position a peripheral edge of said lid at a front peripheral edge of said open front;

a lever with a pivot pin rotatably attached to an upper pin aperture of said handle wherein said lever has a lever arm member rotatably engaged at a lower end with said hinge member;

a strip spring attached at a lever handle member of said lever and configured to urge said hinge member to position said lid cover in a closed position, wherein said strip spring comprises a strip spring member attached at a top surface of said lever handle member that is disposed in a recess formed in a grip portion of said handle wherein said strip spring member extends upwardly and forwardly in said recess to slidably abut an interior surface of said grip portion; and a catch tip formed at an upper end of said strip spring member and positioned to engage a tip recess formed in said grip portion disposed adjacent a forward opening.

10. The dust pan as in claim 9, wherein a flexible seal is disposed at said front peripheral edge of said open front.

11. The dust pan as in claim 9, wherein said lever at said lower end has two prongs disposed to form a fork end to engage a fork pin that is positioned in said upper end of said hinge member wherein said fork pin is spaced apart from said hinge pivot pin and configured to rotate said hinge member upwardly when said lever handle member is forced upwardly away from said top cover.

* * * * *